United States Patent [19]

Driear

[11] Patent Number: 4,468,946

[45] Date of Patent: Sep. 4, 1984

[54] METHOD OF MAKING LAMBDA BEAMS

[75] Inventor: Joseph R. Driear, Thiensville, Wis.

[73] Assignee: Kelley Company Inc., Milwaukee, Wis.

[21] Appl. No.: 393,663

[22] Filed: Jun. 30, 1982

[51] Int. Cl.[3] ..... B21C 37/00; B21D 11/20

[52] U.S. Cl. ..... 72/379; 72/51; 29/155 R; 29/155 C

[58] Field of Search ..... 72/226, 234, 235, 366, 72/368, 379, 411, 181, 51; 29/155 C, 155 R, 150; 52/730–732

[56] References Cited

U.S. PATENT DOCUMENTS

| | | | |
|---|---|---|---|
| 501,900 | 7/1893 | Singer | 73/379 |
| 1,091,381 | 3/1914 | Neuman | 72/181 |
| 1,344,105 | 6/1920 | Vance | 72/368 |
| 1,420,042 | 6/1922 | Kritz | 72/181 |
| 1,749,913 | 3/1930 | Groehn | 72/379 |
| 1,843,064 | 1/1932 | Chesney | 72/379 |
| 4,049,082 | 9/1977 | Reid | 29/150 |
| 4,068,338 | 1/1978 | Artzberger | 14/71.3 |

FOREIGN PATENT DOCUMENTS

| | | | |
|---|---|---|---|
| 589924 | 6/1925 | France | 72/51 |

*Primary Examiner*—Lowell A. Larson

*Attorney, Agent, or Firm*—Andrus, Sceales, Starke & Sawall

[57] ABSTRACT

A method of making a beam having a lambda-shaped cross section from a flat sheet of metal. The longitudinal side edges of the metal sheet are initially bent to provide a generally U-shaped section composed of a flat central web and a pair of side flanges that extend at obtuse angles from the web and are joined to the web at bends. The flat central web is then bent at locations spaced inwardly of the first bends to provide a generally flat base and a pair of side sections that are joined to the base at right angle radiused corners and the outer extremities of the side sections are joined to the respective flanges at the first bends. Each side section is then bent inwardly about the corresponding corner to form the lambda configuration in which the side members are at an acute angle to the longitudinal axis of the beam and the side flanges are in proximate flatwise relation.

8 Claims, 8 Drawing Figures

METHOD OF MAKING LAMBDA BEAMS

BACKGROUND OF THE INVENTION

Lambda-shaped beams have greater torsional rigidity than beams of other configurations, such as I-beams, or H-beams, and have particular application as the supporting structure for a ramp of a dockboard. A typical dockboard is mounted in a pit or depression in a loading dock and includes a ramp that is pivoted at its rear edge to the supporting structure and is movable between a generally horizontal cross traffic position and an upwardly inclined position. Hinged to the forward edge of the ramp is a lip that can be moved from a downwardly hanging pendant position to an outwardly extending position where it forms an extension to the ramp. In operation, the extended lip is adapted to engage the bed of a truck located in front of the dock to provide a continuous platform for material handling equipment moving between the dock and the truck bed.

As the material handling equipment, such as fork lift trucks, do not apply a force equally to all areas of the ramp as the truck moves between the dock and the truck bed, the ramp is subjected in use to considerable torsional stress.

To withstand the torsional stress, the supporting beams, as shown in U.S. Pat. No. 4,068,338 have been formed with a lambda configuration. The lambda beams, which can have a length in the range of about 6 to 12 feet, are normally formed by a rolling process. As rolling mill tooling is extremely expensive, there has been a need to produce lambda-shaped beams by other less expensive procedures.

SUMMARY OF THE INVENTION

The invention is directed to an improved method of forming a beam having a lambda-shaped cross section from a flat sheet of metal. In accordance with the invention, the sheet is initially bent along its side edges to provide a generally U-shaped cross section composed of a flat central web and a pair of side flanges that extend outwardly at obtuse angles from the web and are joined to the web at bends or corners.

The central web is then bent at a pair of locations spaced inwardly from the first bends to provide a beam having a generally flat base structure and a pair of side sections that are joined to the base at right angle radiused corners. The outer extremities of the side sections are connected to the respective side flanges at the first bends.

Following this bending operation, each of the side sections is bent inwardly about the corresponding corner to form the lambda configuration in which the side sections are disposed at an acute angle with respect to the base and the side flanges are disposed in flatwise relation.

Through use of the invention, the lambda beam is formed by less expensive bending operations, making the method particularly adaptable to small quantity outputs and eliminating the need for the more expensive rolling mill equipment.

In accordance with the method of the invention, the final bend to the lambda shape is made without the need for internal support for the beam. This greatly simplifies the tooling required for the operation as well as eliminating the necessity of removing the internal tooling after the final bend has been completed.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
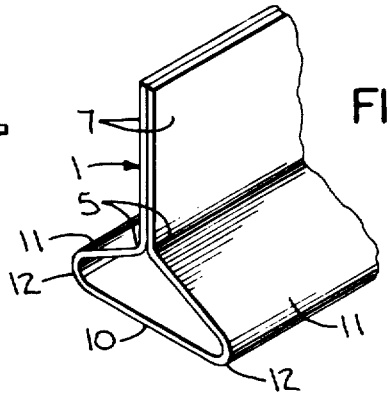
FIG. 1 is a perspective view of a lambda-shaped beam as formed by the present invention.

FIG. 1 illustrates a metal beam 1 having a generally lambda-shaped configuration.

Figure 2:
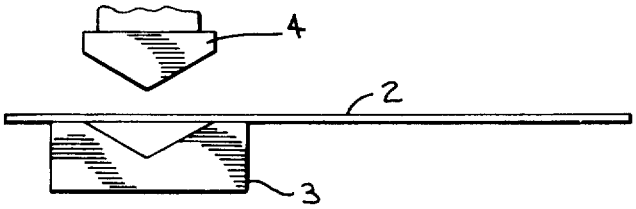
FIG. 2 is a schematic representation showing the flat metal sheet prior to the first bending operations.
Figure 3:
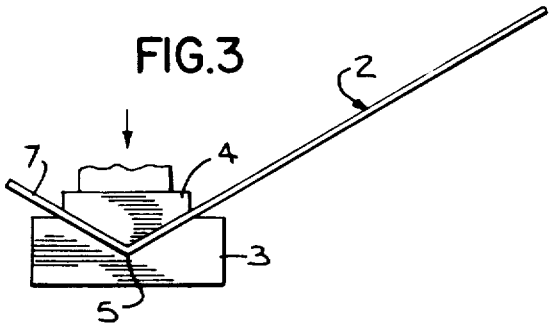
FIG. 3 is a view similar to FIG. 2 showing the sheet after the initial bend.

The invention is directed to a bending method for producing the lambda beam 1 which does not require internal support for the beam during the final bending operation. As shown in FIG. 2, a flat metal sheet 2, which may have a width in the range of about 12 to 18 inches and a length of 4 to 12 feet is positioned between a fixed lower die 3 and a movable upper die 4. Through operation of the movable upper die 4, the sheet 2 is bent as indicated at 5. The sheet 2 is then moved laterally and a second bend 5 is produced through use of the dies 3 and 4 to produce a generally U-shaped structure consisting of a generally flat central section 6 which is connected to side flanges 7 at bends 5. As best illustrated in FIG. 3, side flanges 7 extend at an obtuse angle of about 120° with respect to the central section 6, after springback occurs when the sheet 2 is removed from the bending die.

Figure 4:
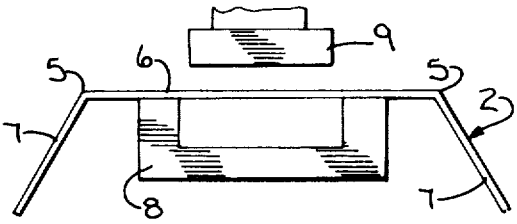
FIG. 4 is a schematic representation showing the sheet prior to the second bending operation.
Figure 5:
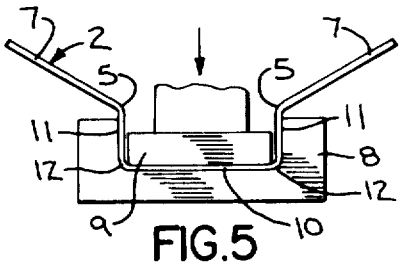
FIG. 5 is a view similar to FIG. 4 showing the sheet after the second bending operation.

The second stage bending operation is illustrated in FIGS. 4 and 5. As shown in FIG. 4, the partially bent sheet 2 is positioned between a lower fixed die 8 and a movable upper die 9, with the side flanges 7 extending downwardly along the lower die 8. Through operation of the upper die 9, the central section 6 is bent at locations inwardly of bends 5 to provide a central base 10 and a pair of side sections 11 which connect base 10 by right angle radiused corners 12.

Figure 6:
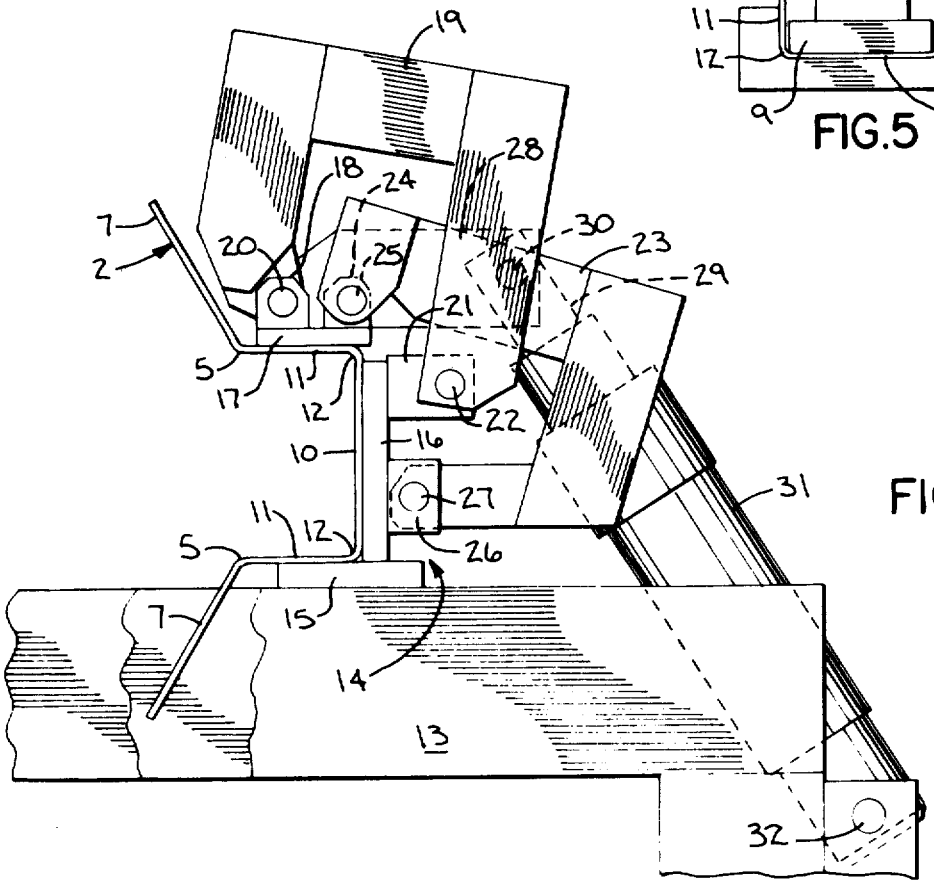
FIG. 6 is a side elevational view of the bending apparatus showing the sheet prior to the bending of one of the side walls to form the lambda shape.
Figure 7:
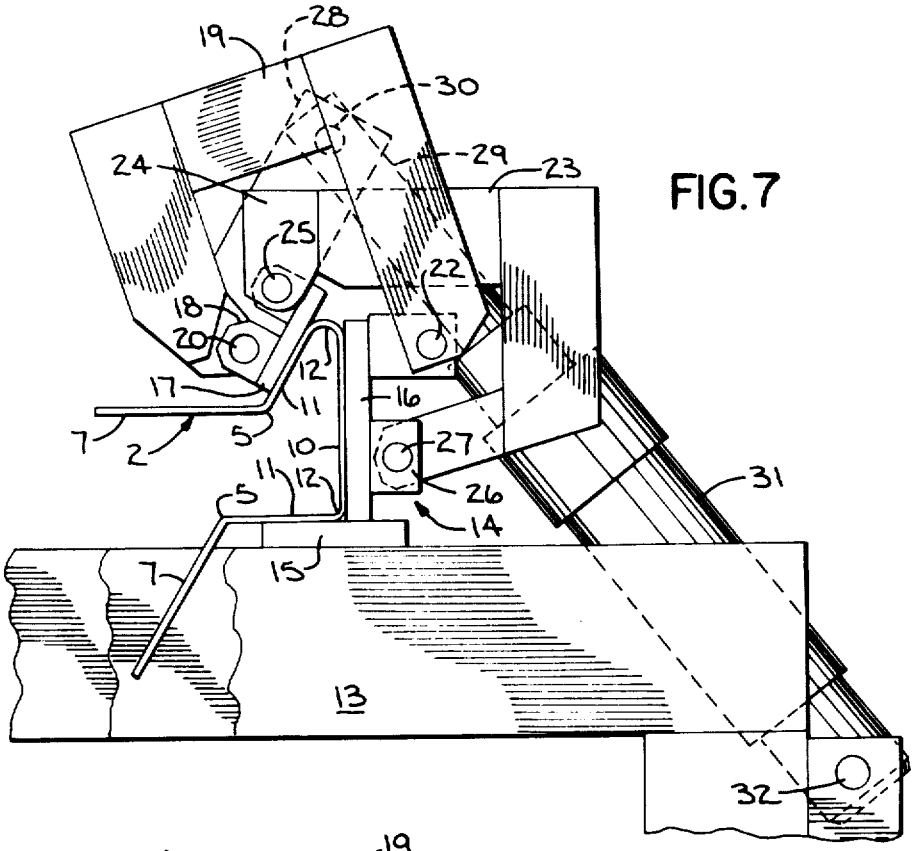
FIG. 7 is a view similar to FIG. 6 showing the bend of one of the side walls to form the lambda shape.
Figure 8:
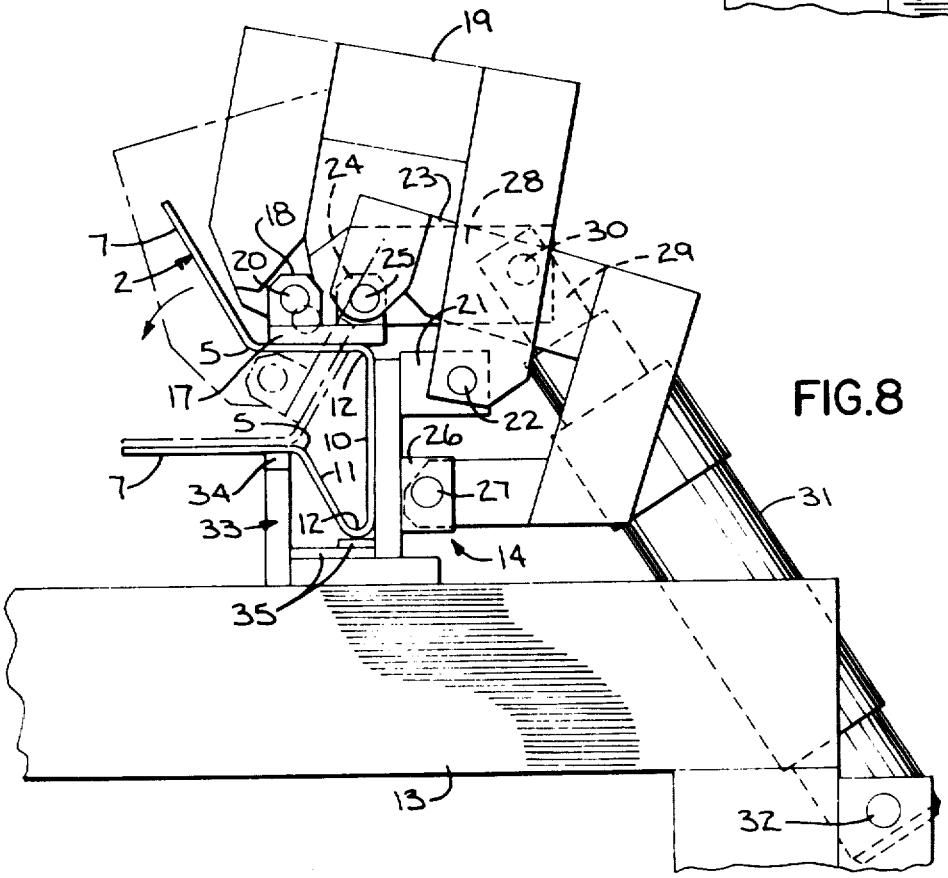
FIG. 8 is a view similar to FIG. 6 showing the sheet prior to the final bend of the other of the side walls.

Following this bending operation, the partially bent structure is placed in a fixture, as shown in FIGS. 6–8, to effect the final bends to lambda shape. In the final bending operation, one of the side sections 11 is bent inwardly around the corresponding corner 12, so that the side section flange 7 is located approximately along the longitudinal axis of the beam, as shown in FIG. 7. Subsequently, the other side section 11 is similarly bent inwardly about the corresponding corner 12 to bring the other side flange 7 into flat-wise contiguous relation, with the first side flange 7, as shown by the phantom lines in FIG. 8.

To complete the assembly, the contiguous side flanges 7 can be spot welded together, or by proper compensation of spring-back by over-bending in FIGS. 7–8, flanges 7 will be together without welding.

The final bends are made without the need for internal support for the beam and are produced by a novel bending mechanism as illustrated in FIGS. 6–8. The bending mechanism includes a base or supporting structure 13 and a jig or fixture 14 is supported on the base. Fixture 14 includes a lower base section 15 which rests on base 13 and a vertical section 16. As shown in FIG. 6, the partially bent sheet 2 is positioned so that the base 10 is in contact with vertical section 16 and the lower bend or corner 12 rests on the horizontal section 15.

The upper side section 11 is bent inwardly by a pivotable platen 17, which is supported through a four-bar linkage. Lug 18 extends upwardly from the forward edge of platen 17 and is connected to one end of a U-shaped link 19 at pivot 20. The opposite end of link 19 is connected to lug 21, which projects rearwardly from vertical section 16, at pivot 22.

A second U-shaped link 23 also interconnects platen 17 to fixture 14. In this regard, one end of link 23 is connected to lug 24 on platen 17 at pivot 25, while the opposite end of link 23 is connected to lug 26 on vertical section 16 at pivot 27.

To pivot the platen 17 downwardly, extension 28 extends rearwardly from the platen and is pivotally connected to the outer end of piston rod 29 by pin 30. Piston rod 29 is slidable within fluid cylinder 31 and the lower end of cylinder 31 is pivotally connected to the base 13 by lugs 32.

To pivot platen 17 downwardly and thereby bend the side section 11 from the position shown in FIG. 6 to the position shown in FIG. 7, piston rod 29 is extended by introducing fluid into the lower end of cylinder 31. With the linkage arrangement as described, the pivot 20 will move in an arc about the pivot 22 and similarly, the pivot 25 will move in an arc about the pivot 27. This, in turn, will cause platen 17 to move outwardly and then pivot downwardly to roll around the corner 12 to provide a rounded acute angle corner, as opposed to a sharply bent corner. The final pivoting movement of platen 17 will swing the side section 11 inwardly with respect to base 10, thereby bringing the side flange 7 to a generally horizontal position as shown in FIG. 7. The angularity of bend 5 is unchanged during the final bending operation, as shown in FIGS. 6 and 7.

After the bend is made, as shown in FIGS, 6 and 7, the partially bent section is reversed in position on the fixture and the opposite side section 11 is bent as illustrated in FIG. 8. In making this bend, a support bar 33 is utilized which includes a vertical section 34 that supports the side flange 7 of the previously bent section. In addition, support 33 can include one or more shims 35 that are positioned beneath the previously bent rounded corner 12. As previously noted, when the first corner 12 is bent inwardly in the final bending operation, the corner is further rounded so that the width of the base 10 is reduced and the shims compensate for this reduction in width.

With the partially formed beam positioned as shown in FIG. 8, platen 17 is again pivoted downwardly through operation of cylinder 31 to provide the final bend and bring the two flanges 7 into contiguous relation, as shown by the phantom lines in FIG. 8.

The invention provides a method of forming a lambda beam by a relatively inexpensive bending operation, thereby eliminating the need for expensive roller mill equipment.

In addition, the bending mechanism enables the final bends to lambda shape to be accomplished without the need for an internal support or mandrel. As the beams have a substantial length, the incorporation of a supporting mandrel would add considerably to the expense of the operation. Furthermore, by eliminating internal support, any problems of removal of the internal support from the completed beams are eliminated.

Various modes of carrying out the invention are contemplated as being within the scope of the following claims particularly pointing out and distinctly claiming the subject matter which is regarded as the invention.

I claim:

1. A method of making a beam having a generally lambda cross section from a flat sheet of metal, comprising the steps of (a) bending the longitudinal side edge portions of a metal sheet to provide a generally U-shaped cross section composed of a generally flat central web and a pair of side flanges that are joined to the web at first junctions, each of said side flanges extending at an obtuse angle with respect to said web, (b) bending the central web at locations spaced inwardly of said first junctions to provide a partially bent sheet including a generally flat base and a pair of side sections extending at an angle of about 90° to said base and joined to said base at corners, said first junctions joining said side sections to the respective side flanges, and (c) bending each side section of said partially bent sheet inwardly about the corresponding corner in a direction toward the other side section to position each side section at an acute angle with respect to the base and to dispose the two side flanges in flatwise contiguous relation and provide a lambda configuration.

2. The method of claim 1, and including the step of maintaining the approximate angularity of said junctions during said bending step (b) and (c).

3. The method of claim 1, and maintaining the partially bent sheet free of internal support during the bending step (c).

4. The method of claim 1, in which said bending step (c) is accomplished by engaging each side section with a platen, and pivoting the platen in a curved path to bend the side section inwardly about the corresponding corner.

5. The method of claim 4, and including the step of mounting the platen to a fixed support through a four-bar linkage and the step of pivoting said platen is carried out by applying a force to the platen at locations spaced from the connections of the four-bar linkage to said platen whereby the platen will pivot to roll the corner and further pivoting action will bend the side section inwardly to said acute angle.

6. The method of claim 1, wherein said side flanges are bent in step (a) to an obtuse angle of 120°.

7. A method of making a beam having a generally lamba cross section from a flat sheet of metal, comprising the steps of (a) bending the longitudinal side edge portions of a metal sheet to provide a generally U-shaped cross section composed of a central web and a pair of side flanges that are joined to the web at first junctions, each of said side flanges extending at an obtuse angle with respect to said web, (b) bending the central web at locations spaced inwardly of said first junctions to provide a partially bent sheet including a generally flat base and a pair of side sections extending at an angle of about 90° to said base and joined to said base at radiused corners, said first junctions joining said side sections to the respective side flanges, (c) bending each side section inwardly toward the other side section about the corresponding corner while maintaining the angularity of said junctions to position each side section at an acute angle with respect to the base and to dispose the two side flanges in flatwise contiguous relation, and (d) maintaining the partially bent sheet free of internal support during bending step (c).

8. The method of claim 7, in which said bending step (c) is accomplished by engaging each side section with a platen, and pivoting the platen in a curved path to form a gradually rounded corner and thereafter bend the side section inwardly about the corresponding corner.

* * * * *